US005969611A

United States Patent [19]

Stocks

[11] Patent Number: 5,969,611

[45] Date of Patent: Oct. 19, 1999

[54] APPARATUS FOR THE SURVEILLANCE OF AN ELECTRONIC SECURITY ELEMENT IN AN INTERROGATION ZONE

[75] Inventor: David Stocks, Melbourn, United Kingdom

[73] Assignee: Esselte Meto International GmbH, Heppenheim, Germany

[21] Appl. No.: 08/974,876

[22] Filed: Nov. 20, 1997

[30] Foreign Application Priority Data

Nov. 20, 1996 [DE] Germany ..... 196 47 905

[51] Int. Cl.[6] ..... G08B 13/14

[52] U.S. Cl. ..... 340/572.4

[58] Field of Search ..... 340/572, 572.4

[56] References Cited

U.S. PATENT DOCUMENTS

| | | | |
|---|---|---|---|
| 4,168,496 | 9/1979 | Lichtblau | 340/572 |
| 4,459,474 | 7/1984 | Walton | 235/380 |
| 4,531,117 | 7/1985 | Nourse et al. | 340/572 |
| 4,663,612 | 5/1987 | Mejia et al. | 340/572 |
| 4,668,942 | 5/1987 | Eccleston et al. | 340/572 X |
| 4,888,579 | 12/1989 | ReMine et al. | 340/572 |
| 4,992,675 | 2/1991 | Conner, Jr. et al. | 327/72 |
| 5,239,459 | 8/1993 | Hunt et al. | 364/400 |
| 5,349,339 | 9/1994 | Kind | 340/572 |

FOREIGN PATENT DOCUMENTS

| | | |
|---|---|---|
| 0186304 | 3/1990 | European Pat. Off. . |
| 2843293 | 12/1985 | Germany . |
| 3505052 | 11/1990 | Germany . |

*Primary Examiner*—Thomas Mullen
*Attorney, Agent, or Firm*—Jones, Tullar & Cooper, P.C.

[57] ABSTRACT

The present invention relates to an apparatus for the surveillance of an electronic security element in an interrogation zone. The essential elements are a transmitting device, a receiving device and a computing/control unit. The transmitting device emits at least one interrogation signal into the interrogation zone. This signal causes the security element to emit a characteristic signal. The receiving device receives the characteristic signal and generates a signal which is an indication of the characteristic signal. The computing/control unit evaluates the signals received from the receiving device and produces an alarm when the presence of the security element is established. The evaluation comprises detecting spikes from the signals received from the receiving device, creating a corresponding signal shape from the spikes in a self-learning process, and removing the determined spikes from the signals received from the receiving device.

9 Claims, 3 Drawing Sheets

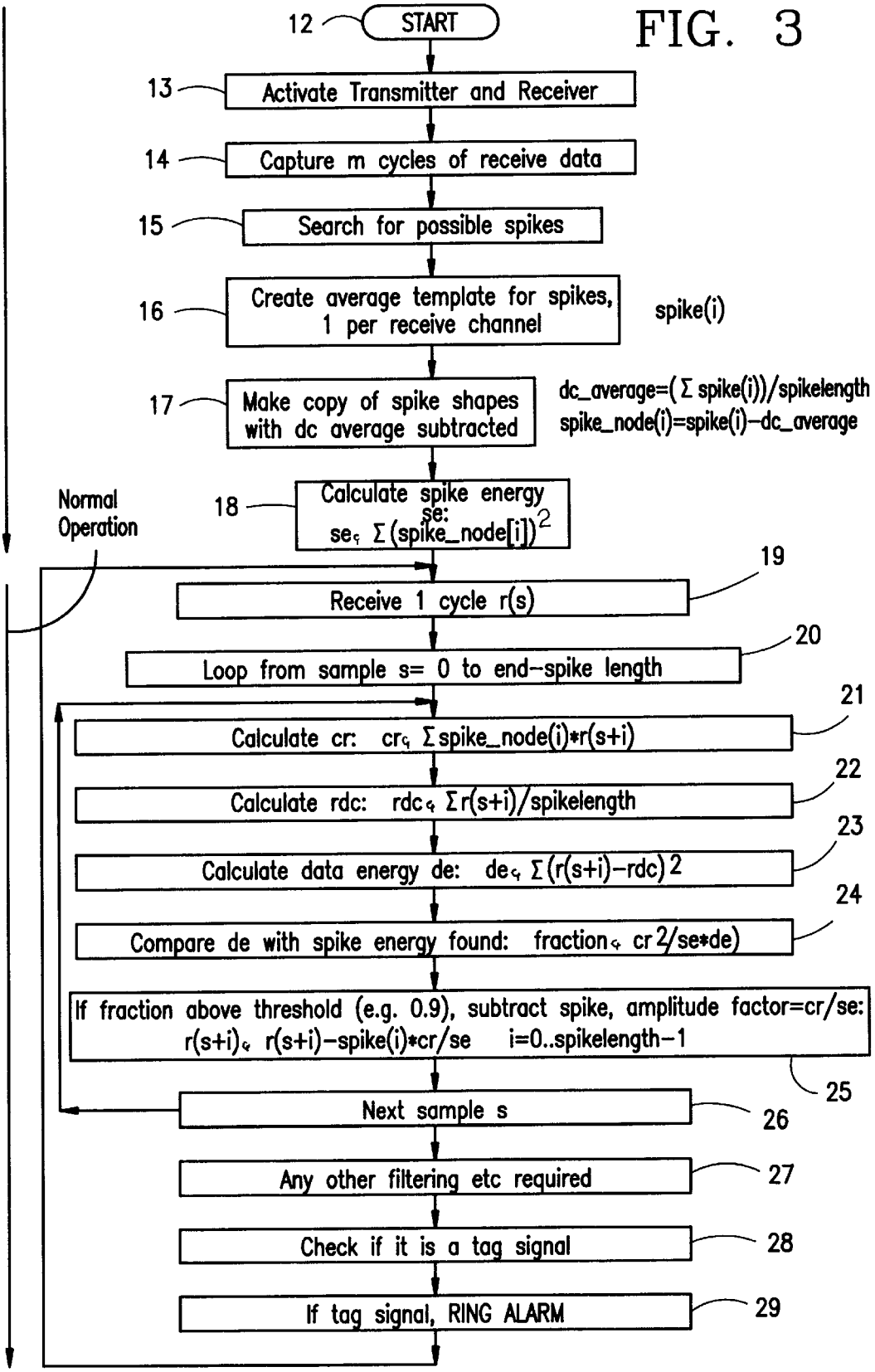
FIG. 3
12
START
13
Activate Transmitter and Receiver
14
Capture m cycles of receive data
15
Search for possible spikes
16
Create average template for spikes, 1 per receive channel
spike(i)
17
Make copy of spike shapes with dc average subtracted
dc_average=(Σ spike(i))/spikelength
spike_node(i)=spike(i)−dc_average
Normal Operation
18
Calculate spike energy se:
se← Σ(spike_node[i])2
19
Receive 1 cycle r(s)
20
Loop from sample s= 0 to end−spike length
21
Calculate cr: cr← Σspike_node(i)*r(s+i)
22
Calculate rdc: rdc← Σr(s+i)/spikelength
23
Calculate data energy de: de← Σ(r(s+i)−rdc)2
24
Compare de with spike energy found: fraction← cr2/se*de)
If fraction above threshold (e.g. 0.9), subtract spike, amplitude factor=cr/se:
r(s+i)← r(s+i)−spike(i)*cr/se i=0..spikelength−1
25
Next sample s
26
Any other filtering etc required
27
Check if it is a tag signal
28
If tag signal, RING ALARM
29

APPARATUS FOR THE SURVEILLANCE OF AN ELECTRONIC SECURITY ELEMENT IN AN INTERROGATION ZONE

BACKGROUND OF THE INVENTION

1. Field of the Invention

The present invention relates to an apparatus for the surveillance of an electronic security element in an interrogation zone. The apparatus has a transmitting device emitting at least one cyclic interrogation signal into the interrogation zone, with the interrogation signal causing the security element to deliver a characteristic signal, a receiving device having at least one receiver channel and receiving the characteristic signal, and a computing/control unit evaluating the signals received from the receiving device and producing an alarm when the presence of the security element is established.

2. Prior Art

To detect the presence of electromagnetic security elements in an interrogation zone, it is proposed in European Patent, EP 123 586 B to emit into the interrogation zone, in addition to two interrogation fields with the frequencies F1 and F2 in the kilohertz range, a field with a low frequency F3 in the hertz range. The two interrogation fields with the frequencies F1 and F2 cause a security element present in the interrogation zone to emit a characteristic signal with the intermodulation frequencies n·F1±m·F2 (where n, m=0,1,2, . . . ). The low-frequency interrogation field causes the security element to be driven from saturation in one direction into saturation in the other direction at the clock rate of this particular field. As a result, the characteristic signal occurs cyclically at the frequency of the low-frequency field.

As an alternative solution, it has further become known to use only one interrogation field in the kilohertz range for excitation of the security element, with the characteristic signal of the security element occurring again at the clock rate of a low-frequency field cycling the soft magnetic, non-linear material between the two states of saturation.

Spikes, that is, high-frequency signals of a bandwidth greater than that of the characteristic signal of a security element, are produced by various interference sources. To name some examples, such spikes may be produced by motors, television monitors or passing streetcars. These spikes cause a lower detection performance and a higher risk of false alarm in an electronic surveillance system. Such false alarms are, of course, highly undesirable, since they are apt to confuse or irritate both staff and customers. To avoid a false alarm caused by spikes, it has only been known hitherto to provide the computing/control unit with predetermined spike templates. In practice, this means that while a spike having the shape of a known spike can be removed from the received signals, this does not apply to a spike differing in shape. This latter spike continues to be a problem in that it results in a poor detection rate and a false alarm of a surveillance system. The same applies in cases where the filtering of the receiving device is not accurately adjusted, or the inductivity or the Q factor of the receiving coils is outside of a predetermined tolerance.

SUMMARY OF THE INVENTION

It is an object of the present invention to provide an apparatus which improves the detection of articles equipped with electronically detectable security elements within an interrogation zone.

This object is accomplished in that the computing/control unit detects spikes from the signals received from the individual receiving channels, creates a corresponding signal shape from these spikes in a self-learning process, and removes the determined spikes from the received signals. The apparatus of the present invention is thus in a position to analyze a wide variety of possible spike shapes and to remove them subsequently from the received signals.

According to an advantageous further feature of the apparatus of the present invention, the computing/control unit determines a spike during an initialization phase as follows: Following activation of the transmitting and receiving devices, the received signals are stored over several cycles (related to the surveillance system described in the introductory portion hereof, the cycle is predetermined by the low-frequency interrogation field) and searched for possible spikes. In the event that at least one spike is detected within the time interval observed, a spike average is created over several cycles; from the spike average, the dc_average is subtracted, where the dc_average is defined as follows:

$$\text{dc_average} := \left(\sum_i \text{spike}(i)\right) \Big/ \text{spike length},$$

wherein i identifies the number of measured values within the spike. Then the computing/control unit calculates the spike energy, storing the information obtained. It has proven to be advantageous for the computing/control unit to calculate the spike energy (se) by means of the following formula:

$$se = \sum_i (\text{spike_}nodc(i))^2,$$

where spike_nodc(i)=spike (i)—dc_average.

According to an advantageous further feature of the apparatus of the present invention, the computing/control unit stores the signals received during one cycle, selecting the signals received from the start of the cycle up to the end of the cycle minus the length of the spike as samples (s).

In order to detect spikes occurring at any time, the computing/control unit advantageously subjects the samples to the following correlation:

$$cr(s) \leftarrow \sum_i \text{spike_}nodc(i) \cdot r(s+i)$$

The computing/control unit calculates the dc average (rdc) of the samples by applying the following formula:

$$rdc(s) \leftarrow \sum_i r(s+i) / \text{spike length}$$

It has proven to be particularly advantageous to identify a spike by making a comparison of the energy of the assumed spike with the energy of the correlated signal. To this end, the computing/control unit calculates the energy of the received signals as follows:

$$de(s) \leftarrow \sum_i (r(s+i) - rdc(s))^2$$

Then it determines the signal fraction as follows:

$$\text{fraction (s)} \leftarrow (\text{cr(s)})^2/(\text{se(s)} \cdot \text{de(s)})$$

If the signal shapes coincide, fraction (s) reaches its maximum value 1. Values lower than 1 identify signal shapes which are more or less similar to the signal shape learned by the self-learning process.

To ensure that the assumed spike is in fact an interference, the spike is removed from the received signals only if the fraction (s) determined by means of the energies is above a predetermined threshold. This threshold is advantageously at 0.9.

The present invention will be described in more detail in the following with reference to the accompanying drawings. In the drawings,

BRIEF DESCRIPTION OF THE DRAWINGS

FIG. 3 is a flowchart of an advantageous program for controlling the apparatus of the present invention.

DETAILED DESCRIPTION

Figure 1:
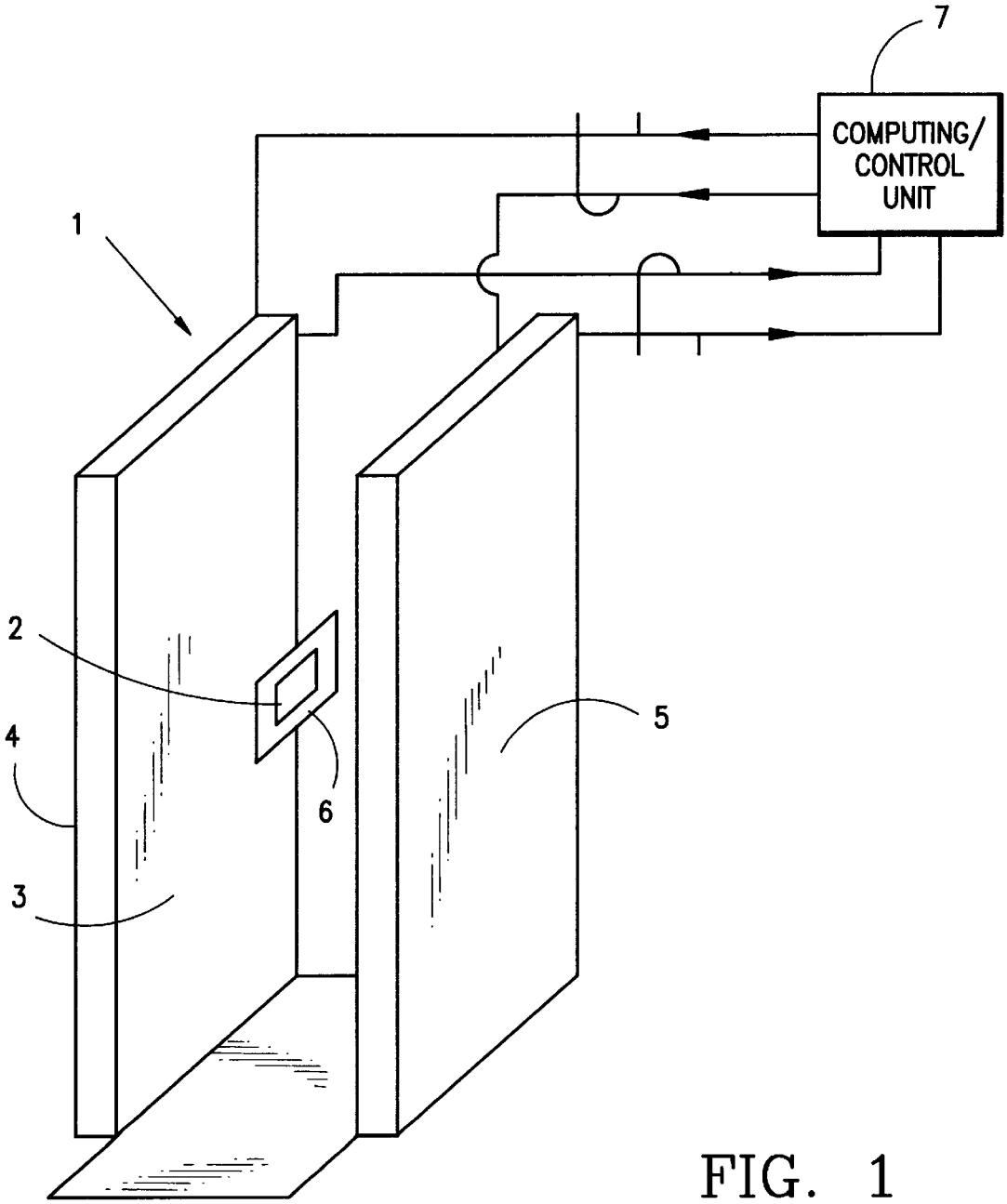
FIG. 1 is a schematic illustration of the apparatus of the present invention for detecting the presence of an article provided with a security element in an interrogation zone.

Referring now to FIG. 1, there is shown schematically the apparatus 1 of the present invention for detecting the presence of an article 6 provided with a security element 2 in an interrogation zone 3. The interrogation zone 3 is defined by two detector antennas disposed in substantially parallel arrangement and accommodating the transmitting device 4 and the receiving device 5. It will be understood, of course, that both devices 4, 5 may also be accommodated in one detector antenna. Control of the surveillance apparatus 1 and evaluation of the measured values are by means of the computing/control unit 7.

Figure 2:
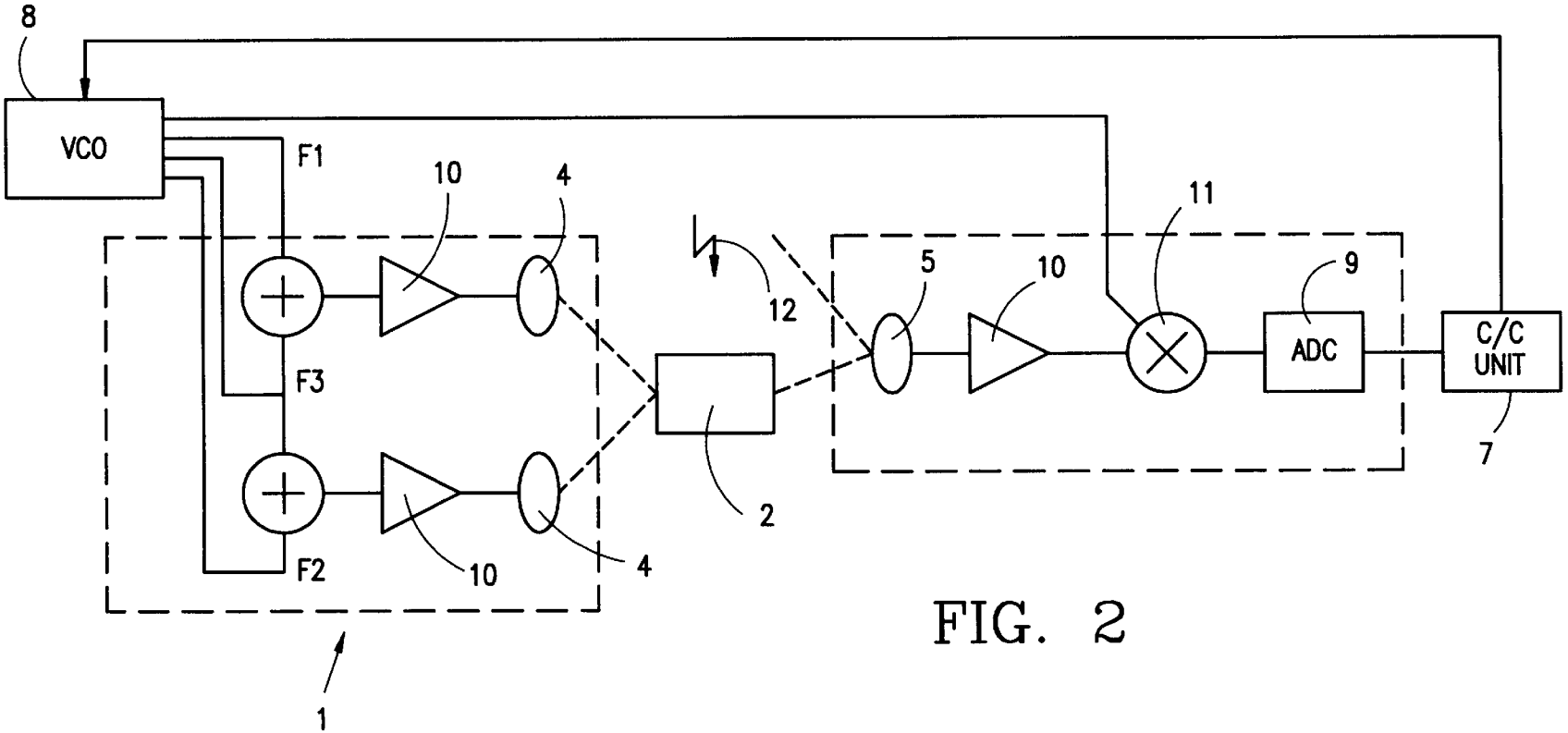
FIG. 2 is a block circuit diagram of an advantageous configuration of the apparatus of the present invention.

FIG. 2 shows a block circuit diagram of a surveillance system for electromagnetic security elements 2. The two transmitting antennas of the transmitting device 4 deliver magnetic interrogation fields with frequencies F1, F2 and F3 into the interrogation zone 3. These interrogation fields are generated by a voltage-controlled oscillator 8 and amplified by amplifiers 10. The interrogation signals cause the electromagnetic security element 2, which is essentially comprised of a metal having non-linear magnetic properties, to emit characteristic signals at the clock rate of the low-frequency interrogation field F3. The low-frequency interrogation field F3 determines a cycle. The signals r(s) received by the receiving device 5 are amplified (amplifier 10) and passed through the analog-to-digital converter 9 to the computing/control unit 7 for evaluation.

FIG. 3 shows a flowchart of an advantageous program for controlling the apparatus 1 of the present invention. Program start is at reference numeral 12; at 13, both the transmitting device 4 and the receiving device 5 are activated. As indicated at 14, the received signals r(s) are stored over several cycles m, where m is an integer. At 15, the received signals r(s) are searched for possible spikes, and per received channel one average template is created for the occurring spikes (at 16). At 17, a copy of the spike shapes is made with the dc average subtracted. The initialization phase ends at 18 at which point the energy se(i) of the individual spikes is calculated.

The control program starts at 19, ending at 29 and returning to 19 in a loop. At 19, the signals received during one cycle are stored; at 20, samples are selected from the stored received signals r(s), covering the range from the first received signal (s=0 at start of cycle) to the end minus the spike length. At 21, these samples are correlated applying the following formula:

$$cr(s) \leftarrow \sum_i \text{spike_}nodc(i) \cdot r(s+i)$$

whereby i=0, 1, . . . spike_length−1

At 22, the dc average of the samples is calculated as follows:

$$rdc(s) \leftarrow \sum_i r(s+i) / \text{spike length}$$

At 23, the computing/control unit 7 calculates the energy (de) of the samples according to the following formula:

$$de(s) \leftarrow \sum_i (r(s+i) - rdc(s))^2$$

At 24, the fraction of the samples is calculated as follows:

$$\text{fraction } (s) \leftarrow (cr(s))^2/(se(s) \cdot de(s))$$

If this fraction (s) is above a predetermined threshold (conventionally this threshold is at 0.9), it is assumed that a spike is involved because of the great similarity of the two signal shapes. Then the spike, multiplied by the amplitude factor cr/se, is subtracted from the received signals (at 25). At 26, the next samples are stored, and the program repeats steps 21 through 25. When all groups of the samples of the cycle have been considered in succession, the receiving signals following the elimination of the spike signal(s) are filtered by a low pass filter. By reducing the band width of the received signals after elimination of the spike signals the detection rate of the electronic article surveillance system can be increased considerably. At 28, the amended received signals r'(s) are checked for a characteristic signal of a security element 2. If the result of this check is positive, an alarm will be activated at 29. Upon completion of the check, the control program returns to 19, starting the next monitoring and correction cycle.

What is claimed is:

1. An apparatus for the surveillance of an electronic security element in an interrogation zone, comprising:

a transmitting device for emitting at least one cyclic interrogation signal into the interrogation zone, said interrogation signal causing the security element to emit a characteristic signal;

a receiving device having at least one receiving channel for receiving said characteristic signal and generating a signal indicative thereof; and a computing/control unit for evaluating the signals received from said receiving device and producing an alarm when the presence of the security element is established, said evaluation comprising detecting spikes from the signals received from said receiving channels, creating a corresponding signal shape from said spikes in a self-learning process, and removing the determined spikes from the signals received from said receiving channels, wherein said computing/control unit includes spike determining means which determine a possible spike during an initialization phase by storing the received signals over several cycles and searching for possible spikes following activation of said transmitting device and said receiving device, creating a spike average over several cycles in the event that at least one spike is detected, and from the spike average a dc-average is subtracted.

2. The apparatus as defined in claim 1, wherein said dc_average is defined as:

$$\text{dc_average:} = \left(\sum_i spike(i)\right) \Big/ \text{spike length},$$

where: i identifies the number of measured values cover the spike width=0, 1, . . . , spike_length−1; the energy (se) of the spike is calculated and the information on the spike stored.

3. The apparatus as defined in claim 2, wherein said computing/control unit calculates the spike energy (se) by means of the following formula:

$$\text{spike energy } se = \sum_i (\text{spike_}nodc(i))^2$$

where: spike_nodc(i)=spike(i)−dc_average.

4. The apparatus as defined in claim 1, wherein said computing/control unit subjects the stored samples to the following correlation:

$$cr(s) \leftarrow \sum_i \text{spike_}nodc(i) \cdot r(s+i)$$

.

5. The apparatus as defined in claim 4, wherein said computing/control unit calculates the dc average (rdc) of the samples by applying the following formula:

$$rdc(s) \leftarrow \sum_i r(s+i) / \text{spike length}$$

.

6. The apparatus as defined in claim 5, wherein said computing/control unit calculates the energy of the respective samples as follows:

$$de(s) \leftarrow \sum_i (r(s+i) - rdc(s))^2$$

.

7. The apparatus as defined in claim 6, wherein said computing/control unit compares the signal shapes of samples and spikes by applying the following formula:

$$\text{fraction } (s) \leftarrow (cr(s))^2/(se(s) \cdot de(s)).$$

8. The apparatus as defined in claim 7, wherein said computing/control unit subtracts the spike from the received signals if the fraction (s) exceeds a predetermined threshold.

9. The apparatus as defined in claim 1, wherein said computing/control unit checks at predetermined intervals whether the received data is filtered through a low-pass filter following elimination of the spikes.

* * * * *